United States Patent [19]

Neville

[11] Patent Number: 4,528,938

[45] Date of Patent: Jul. 16, 1985

[54] ROTARY WORKPIECE TREATING APPARATUS

[75] Inventor: Glen F. Neville, Howell, Mich.

[73] Assignee: Arrow-Profile, Inc., Warren, Mich.

[21] Appl. No.: 614,751

[22] Filed: May 29, 1984

[51] Int. Cl.[3] ..... B05C 3/02

[52] U.S. Cl. ..... 118/711; 118/408; 118/411

[58] Field of Search ..... 118/681, 684, 710, 711, 118/408, 410, 411; 141/146, 147, 144, 145, 263, 264, 193

[56] References Cited

U.S. PATENT DOCUMENTS 3,605,827 9/1971 Risser ..... 141/147

3,817,210 6/1974 Greever ..... 118/408

*Primary Examiner*—Norman Morgenstern

*Assistant Examiner*—Ken Jaconetty

*Attorney, Agent, or Firm*—Harness, Dickey & Pierce

[57] ABSTRACT

A rotary workpiece treating apparatus is described particularly useful for depositing coating or adhesive materials within threaded fastener nuts. The device includes a continuously rotating turntable assembly having a plurality of workstation cylinders attached thereto. Installed within the cylinders are plungers having cam followers, which plungers move between a first and second position as the turntable assembly is rotated. A probe attached to the plunger is caused to enter within the internal bore of the nuts and release flowable material within the nut. The flow of such material is controlled by a valve stem protruding from the probe which is depressed against a stop surface when the probe is inserted within the nuts. A second clamping plunger within the cylinder clamps against the nut when the probe is being inserted, thereby positioning the nut and preventing flowable material from being deposited on the exterior surfaces of the nuts. The clamping plunger further acts to prevent discharge of flowable material from the probe when a nut is not positioned at the workstation position.

16 Claims, 7 Drawing Figures

ROTARY WORKPIECE TREATING APPARATUS

BACKGROUND AND SUMMARY OF THE INVENTION

This invention relates to an apparatus for treating workpieces and particularly, to a device and method for coating internal cavities of workpieces such as fastener nuts with fluid materials.

Various coatings of fluid materials are applied to the internal surfaces of nut type fastener parts as well as external surfaces of the corresponding fastener parts. Such coatings may be used as sealants to prevent fluid leakage through the fastened connection and/or as a means of providing adhesive bonding between parts, thereby increasing unfastening effort.

Although various machines are known to the prior art for coating workpieces with fluid materials, it is desirable to provide an improved machine which features increased production rate capability and reliability. It is further desirable to provide such a device which prevents the fluid coating material from being discharged by the machine when a workpiece is not placed at a workstation, thereby avoiding waste of the material and preventing it from contaminating the working mechanism of the machine. It is also advantageous to provide such a machine which accurately applies the fluid coating material at the desired location within the internal workpiece cavity. It is further advantageous to provide such a device for which the rate of production may be varied in accordance with production plant schedules. Finally, it is desirable to provide a workpiece treating machine which may be conveniently and easily modified and/or adjusted to accept different types of workpieces and workpieces of differing dimensions.

The above benefits are provided by a machine and method according to this invention. The device described herein includes a plurality of workstations which are attached to a rotating turntable assembly. Each workstation includes an elongated cylinder having internally disposed first and second plungers. The first plunger features a cam follower which moves along a cam surface as the turntable is rotated, causing the plunger to be displaced between two positions. An elongated hollow probe is attached to the first plunger and is caused to move between a position enclosed within the cylinder to a position extended into the workpiece as the turntable is rotated. A valve stem protrudes from the probe which causes the fluid coating material to be applied to the internal cavity of the workpiece when it becomes depressed against a stop. In accordance with a significant aspect of this invention, a second plunger is also provided within the cylinder which performs the dual functions of acting to clamp the workpiece as the probe is inserted therein and also acting to prevent the flow of coating material from the exit ports of the probe when a workpiece is not placed at the workstation; which might occur for instance, when the workpiece flow from a feeder mechanism is interrupted. Since this device includes a continuously rotating turntable, its drive system is less complex than machines which require that workpieces be moved between and stopped at indexed positions.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
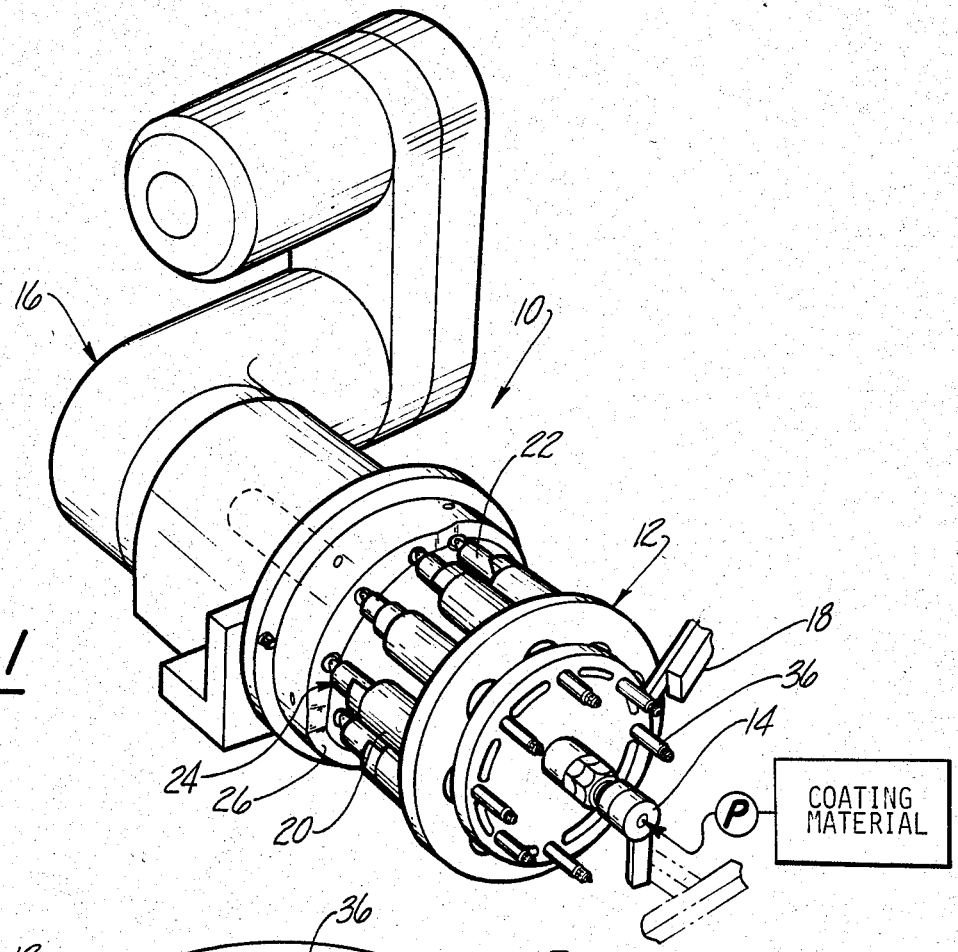
FIG. 1 is a pictorial view of a rotary workpiece treating apparatus according to this invention.

A rotary workpiece treating apparatus according to this invention is shown assembled in FIG. 1 and is generally designated there by reference character 10. Apparatus 10 includes turntable assembly 12 which is caused to rotate by drive transmission assembly 16. Coating material 40 is supplied to turntable assembly 12 through coupling 14. Workpieces are supplied to the device by feeding mechanism 18. As is shown by FIG. 1, a plurality of workstation cylinders 20 are mounted to turntable assembly 10. Each of the cylinders 20 include an internal plunger 22 having cam followers 24 at their extreme ends which travel along cam surface 26 as turntable assembly 12 is caused to rotate. Drive transmission 16 is preferably a variable speed type, enabling the rotary speed at which turntable assembly 12 is rotated to be varied.

Figure 2:
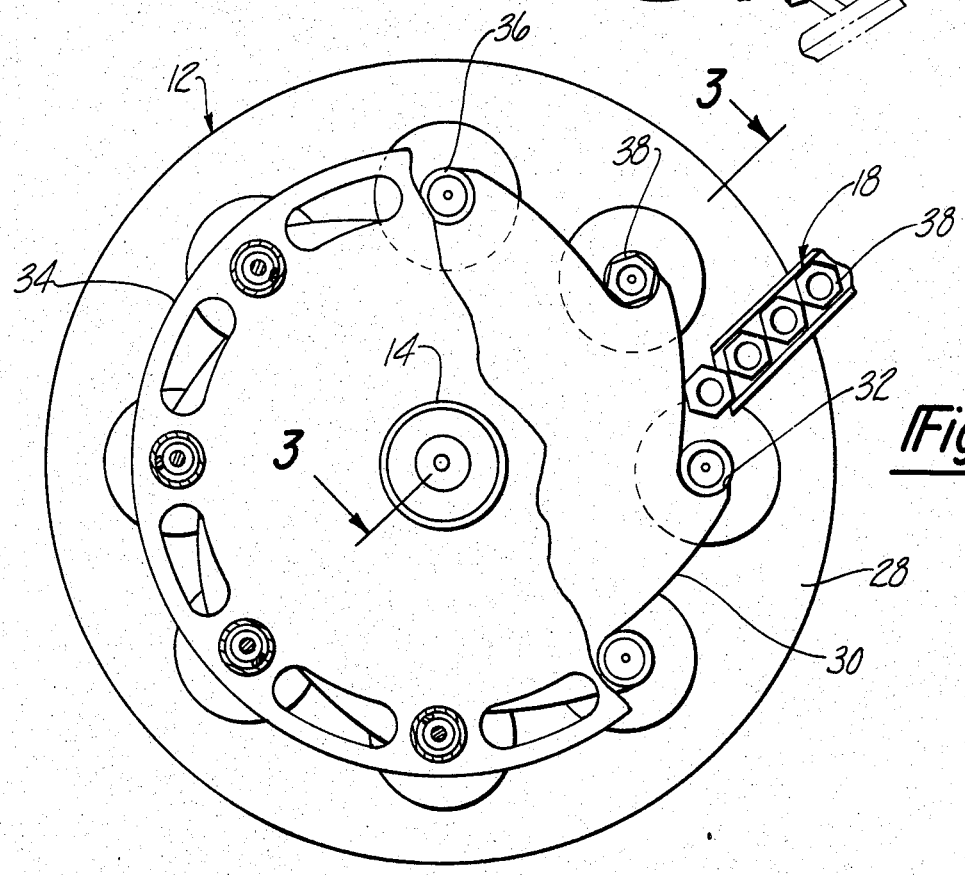
FIG. 2 is a frontal view of the turntable assembly wherein the third turntable plate is partially cut away to reveal the structure of the workpiece positioning second plate.

FIG. 2 is a frontal view illustrating the three plates which make up a portion of turntable assembly 12. First plate 28 provides a mounting location for each of the cylinders 20. As best shown by the portion of FIG. 2 where third plate 34 is cut away, second plate 30 includes an irregularly shaped peripheral edge forming a plurality of notches 32 which are positioned in registry with cylinders 20. Third plate 34 provides a mounting platform for a plurality of stop cylinders 36 which are also positioned in registry with cylinders 20. As is shown by FIG. 2, workpieces such as internally threaded nuts 38 are loaded onto a workstation at approximately the three o'clock position, with reference to the orientation of components shown by FIG. 2. Nuts 38 are supplied by feeding mechanism 18 which can be of any conventional type, such as a vibrating parts shaker assembly according to prior art designs. Individual nuts are positioned within notch 32 as turntable assembly 12 is caused to rotate. As nuts 38 are rotated in a counterclockwise direction, fluid coating material 40 is deposited therein, as will be subsequently described in greater detail. Once nut 38 reaches a position corresponding to approximately nine o'clock, the nuts are permitted to escape from engagement with notch 32 by gravity. Coating material 40 may be one of any number of types of materials which may be deposited upon workpieces and fasteners. For example, sealers are employed to render a threaded connection fluid tight and/or adhesive bonding materials may also be applied in order to prevent fastener loosening during use. In accordance with this invention, it is possible to use any number of fluid materials which are desired to be applied to workpieces having an internal cavity such as nut 38.

Figure 3:
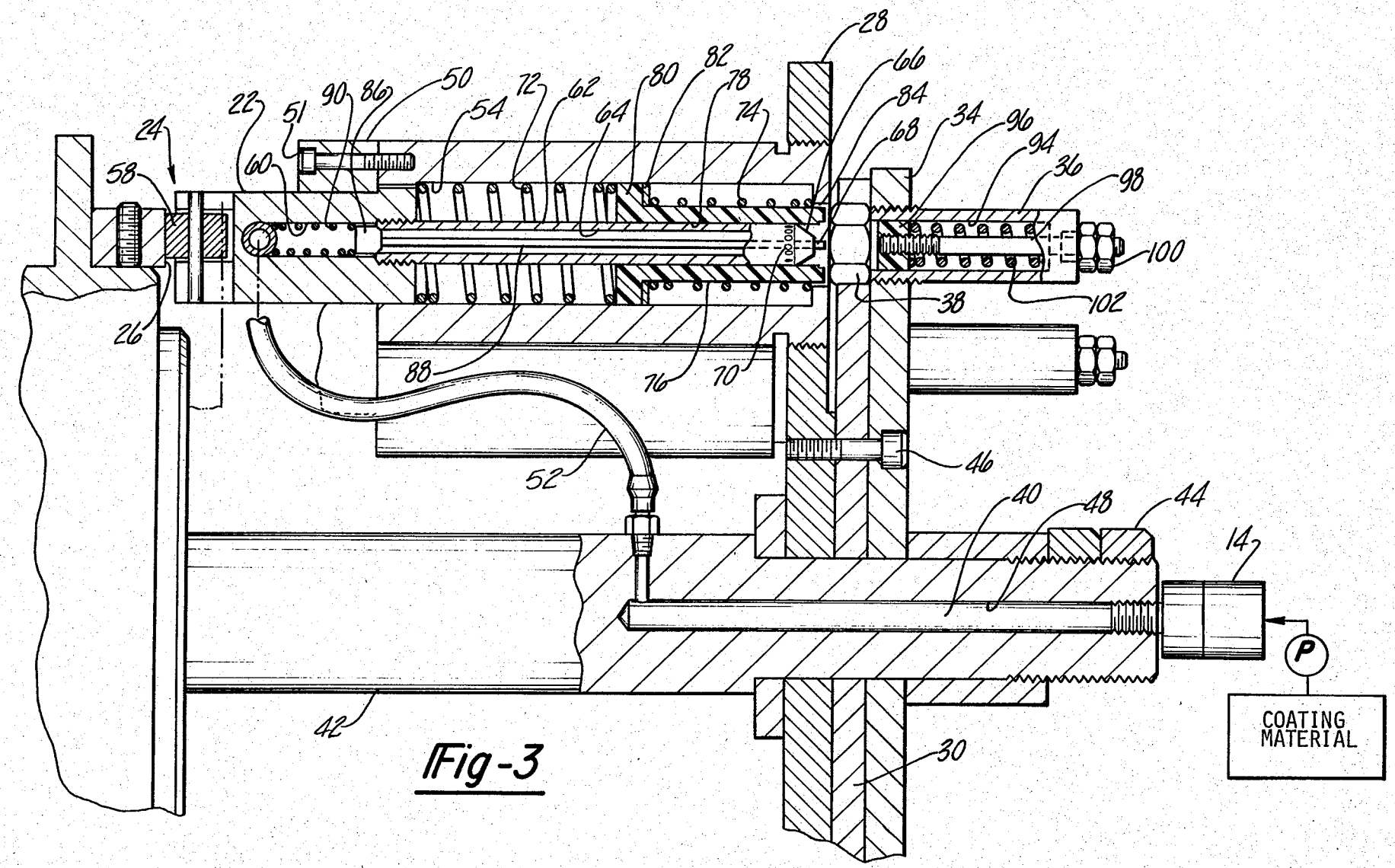
FIG. 3 is a longitudinal sectional view taken along line 3—3 of FIG. 2 showing the internal components of the turntable drive spindle and one of the workstation cylinders according to this invention.

FIG. 3 illustrates the internal components of turntable assembly 12, cylinder 20 and turntable drive spindle 42. Drive spindle 42 is caused to rotate by drive transmission assembly 16. Plates 28, 30 and 34 are fastened onto spindle 42 using jam nuts 44, or may be otherwise journaled onto the spindle so that each plate rotates with the spindle. In order to prevent relative rotation between the plates, one or more screws 46 may be employed which clamp the plates together. By assembling turntable assembly 12 from separate plate members, workpiece treating apparatus 10 can be adapted for different types and dimensions of workpieces, particularly by varying the thickness of second plate 30 and the shape of notches 32. Spindle 42 includes internal bore 48 through which coating material 40 is conducted. Coupling 14 is provided enabling material 40 to be supplied to the relatively rotating spindle 42. Spindle 42 further forms one or more radially disposed ports through which flowable material 40 is conducted into flexible tube 52 which is also connected to cylinder 20.

Disposed within internal bore 54 of cylinder 20 is plunger 22 which has a cam follower rotating wheel 58 attached at the protruding end thereof. Keeper 50 is attached to cylinder 20 by screw 51 and maintains plunger 22 within cylinder bore 54. As turntable assembly 12 rotates, cam follower wheel 58 travels along cam surface 26 causing plunger 22 to translate from the position shown in FIG. 3 to a displaced inserted position. Plunger 22 also includes an internal bore 60. Threadingly connected to plunger 22 is elongated probe 62 having an internal bore 64 and is attached to plunger 22 such that their internal bores are in communication. The extreme end of probe 62 features tapered end 66 having end bore 68 and a plurality of radially directed coating material discharge ports 70. Plunger 22 preferably has an outside diameter which fits closely within nut 38. Since probe 62 is removably attached to plunger 22, different probes may be attached depending upon the type and size of workpiece being treated. Translation of plunger 22 causes probe 62 to be moved from the position shown by FIG. 3, to a displaced position wherein discharge ports 70 are in registry with the internal cavity of nut 38. Plunger 22 is biased to the left, with respect to the position shown by FIG. 3, by a pair of coil springs 72 and 74. These coil springs 72 and 74, combine to urge cam follower wheel 58 in contact with cam surface 26 as turntable assembly 12 is rotated. Also installed within cylinder 20 is clamping plunger 76. Plunger 76 has a bore 78 which closely receives probe 62. Clamping plunger 76 further includes flared portion 80 which provides a location for contact between coil springs 72 and 74. Washer 82 is provided at the contact point between spring 74 and flared portion 80 to mimimize stress concentrations on plunger 76. The opposite end of coil spring 74 contacts radially inward shoulder 84 formed by internal bore 54 which acts to retain the spring in position within the bore. A valve is installed within probe 62 which includes plug 86 having valve stem 88 attached thereto. Valve stem 88 protrudes from exposed bore 68 of probe 62. Plug 86 is dimensioned so that it is translatable within internal bore 60 of plunger 22 but has a diameter larger than bore 64 of probe 62 such that, in the position shown by FIG. 3, it acts as a barrier for fluid communication between these bore sections. When valve stem 88 is depressed toward probe 62, plug 86 moves away from the shoulder formed by the two diameter sections, thereby providing fluid communication between the two bores as generally designated by the arrows in FIG. 4. Plug 86 is, however, normally biased toward the closed position by coil spring 90.

With reference to FIG. 3, stop cylinder 36 is shown threadingly engaging third plate member 34. Stop cylinder 36 has internal bore 94 and is located so that its longitudinal axis is collinear with that of cylinder 20. Disposed within stop cylinder internal bore 94 is stop head 96 threadingly attached to rod 98 which, in turn, is positioned by the location of jam nuts 100. Spring 102 biases stop head 96 toward probe 62. The axial position of stop head 96 within bore 94 is adjustable by the extent of threaded engagement of jam nuts 100 onto rod 98.

Figure 4:
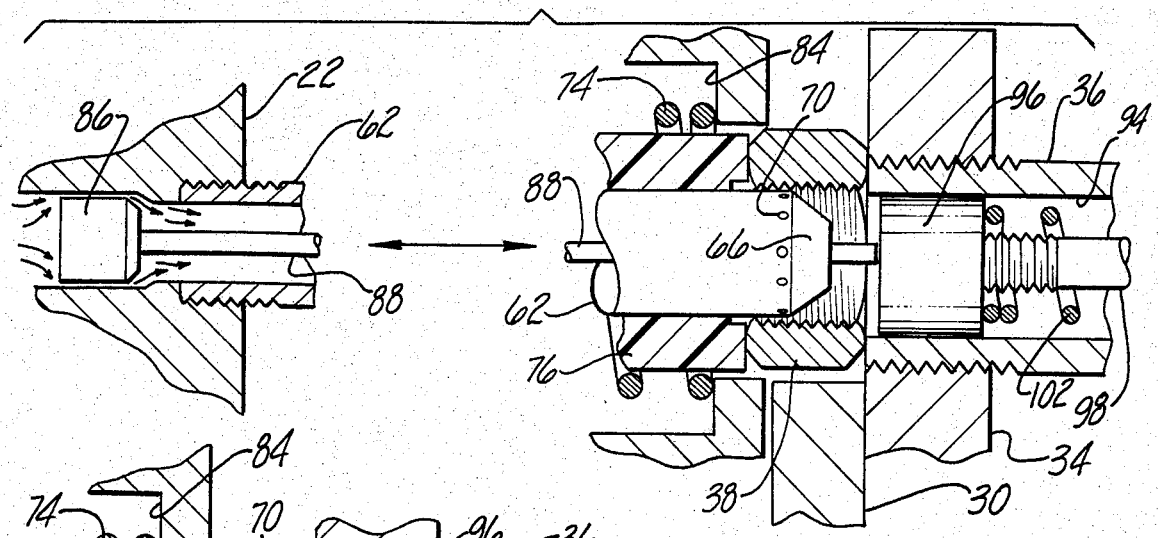
FIG. 4 is a partial sectional view showing the probe extending within a threaded nut workpiece and further showing the interaction between the valve plug and the stepped internal probe bore.
Figure 5:
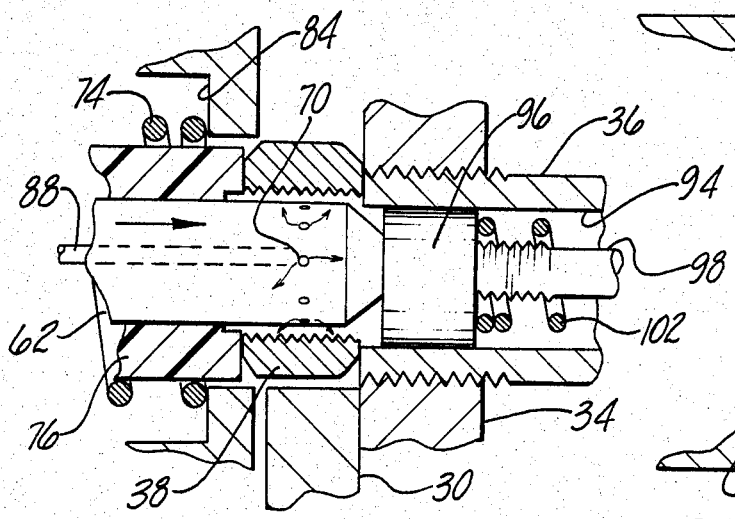
FIG. 5 shows the probe injecting fluid coating material within a threaded nut workpiece.
Figure 6:
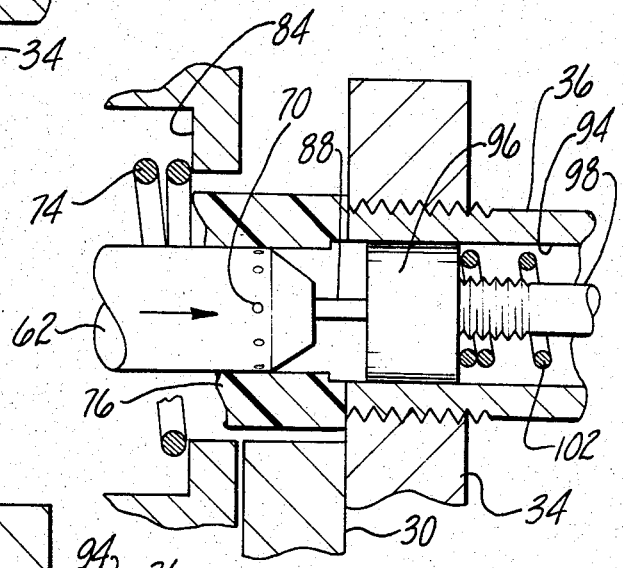
FIG. 6 shows the second plunger extended and contacting the third plate of the turntable assembly when a workpiece is not positioned in registry with a workstation cylinder.
Figure 7:
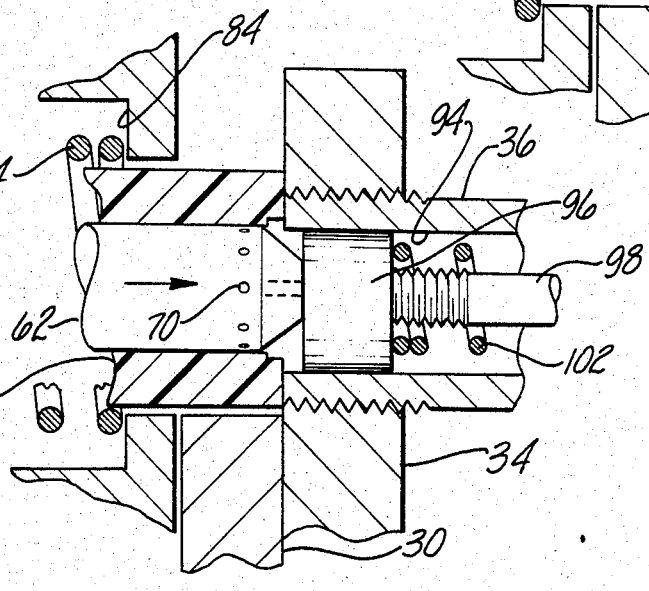
FIG. 7 shows that when a workpiece is not properly positioned relative to a workstation cylinder, the internal bore of the second plunger prevents coating material from being discharged through the probe ports.

The operation of rotary workpiece treating apparatus 10 will now be explained in detail. Beginning with the workstation at the three o'clock position, with reference to FIG. 2, nut 38 is loaded into notch 32. Once nut 38 is loaded and rotated to a displaced counterclockwise position, the components of apparatus 10 assume the position shown in FIG. 3. As shown by that Figure, nut 38 is positioned in registry with cylinder 20 and stop cylinder 36. As turntable assembly 12 is rotated to a more advanced counterclockwise position, the internal components assume the positions shown with reference to FIGS. 4 and 5. As cam follower wheel 58 moves along cam surface 26, plunger 22 is displaced toward a position inserted within bore 54. As shown by FIG. 4, probe 62 becomes inserted within the internal cavity of nut 38. Tapered end 66 of probe 62 aids in positioning of nut 38 and enables probe insertion if the nut is located slightly off center. Once in the position shown by FIG. 4, valve stem 88 comes in contact with stop head 96 which causes relative displacement between rod 88 within probe 62. As shown on the left hand side of FIG. 4, such depressing action on the valve stem causes plug 86 to become unseated and positioned to permit flow of coating material 40 through probe internal bore 64. As shown by the arrow in FIG. 5, this position permits coating material 40 to flow through discharge ports 70 onto the desired internal surfaces of nut 38. Coil spring 102 within stop cylinder 36 permits stop head 96 to be displaced slightly toward the right upon contact with probe 62. This provision allows some compliance in the system to prevent component damage due to slight variations and inaccuracies in positioning of stop head 96 with respect to cam surface 26 and other component variations. Also, as shown by FIGS. 4 and 5, once plunger 22 is moved toward a displaced position, compression of coil spring 72 urges clamping plunger 76 toward the right, thereby clamping nut 38 firmly between it and third plate 34. This clamping feature positions nut 38 and prevents flowable material 40 from coming in contact with external surfaces of nut 38. As previously described, as turntable 12 is rotated past the position which relates to FIGS. 4 through 7 and reaches a nine o'clock position with reference to FIG. 3, nuts 38 simply fall by gravity into a workpiece receiving bin.

In accordance with another principal aspect of this invention, coating material 40 is prevented from escaping from probe 62 in the event that nut 38 is not positioned in registry with cylinders 20 and 36. This provision is best explained with reference to FIGS. 6 and 7. These figures illustrate the positioning of the internal components once plunger 22 is displaced toward an inserted position within cylinder 20 and nut 38 is absent. As occurred with reference to FIGS. 4 and 5, clamping plunger 76 is biased toward third plate 34. In this condition, however, since nut 38 is absent, clamping plunger 76 is displaced until it contacts third plate 34. Once in this position, clamping plunger 76 prevents coating material 40 from being discharged from ports 70 due to the close fit between probe 62 and clamping plunger internal bore 78. This feature prevents waste of coating material when nuts 38 are absent and further prevents material 40 from contaminating the mechanical components of rotary workpiece treating apparatus 10 in such conditions.

As would be evident from one having ordinary skill in the art to which this invention is directed, it is necessary to choose the spring rates of the various springs described above, such that the above described operation results. For example, it would be necessary to design spring 90 to have a compliance which enables valve stem 88 to unseat plug 86 prior to significant compression of spring 102 within stop cylinder 36. It is also necessary to choose the spring rates of spring 72 and 74 in order to provide the desired clamping effect upon nut 38.

While the above description constitutes the preferred embodiments of the present invention, it will be appreciated that the invention is susceptible to modification, variation and change without departing from the proper scope and fair meaning of the accompanying claims.

What is claimed is:

1. A rotary machine for applying fluid material within workpieces having an internal cavity comprising:

a rotating turntable forming at least one peripheral notch for positioning said workpiece, at least one cylinder having an internal bore, said cylinder attached to said turntable, a first plunger disposed within said cylinder bore, said first plunger further having a cam follower, an elongated probe connected to said first plunger and movable therewith having an internal bore therein and forming at least one material discharge port communicating with said probe bore, means for supplying said fluid material to said probe bore, a non-rotating cam surface communicating with said cam follower causing said first plunger to move between a first position to a second inserted position as said turntable is rotated, valve means having a valve stem protruding from said probe, said valve stem movable between a first material shutoff position to a second depressed position at which said material is permitted to flow through said probe discharge port, and stop means operatively associated with said turntable such that when said first plunger is in said first position, said workpiece is insertable within said notch and wherein as said plunger is moved to said second position said probe is inserted within said workpiece internal cavity and said valve stem is depressed against said stop means thereby causing said material to flow through said discharge port into said internal cavity of said workpiece.

2. The rotary machine according to claim 1 wherein said workpieces are internally threaded nuts.

3. The rotary machine according to claim 2 wherein a plurality of said cylinders are provided and are attached to said turntable such that a plurality of said nuts may be retained within a plurality of said notches simultaneously.

4. The rotary machine according to claim 1 further comprising: means for preventing said material from flowing through said probe discharge port when said first plunger is in said second position and when a workpiece is not positioned within said notch.

5. The rotary machine according to claim 4 wherein said means comprises a clamping plunger disposed within said cylinder bore, said clamping plunger having an internal bore which closely receives said probe, said clamping plunger moving with said first plunger when a workpiece is not positioned within said notch so that said probe discharge port is closed off by said clamping cylinder internal bore thereby preventing discharge of said material when said workpiece is not positioned within said notch.

6. The rotary machine according to claim 1 further comprising: means for clamping said workpiece within said notch when said first plunger is in said second position.

7. The rotary machine according to claim 6 wherein said means comprises a clamping plunger disposed within said cylinder bore which clamps against said workpiece when said first plunger is moved to said second position.

8. The rotary machine according to claim 1 wherein said turntable comprises a first plate having said cylinder attached thereto, and a second plate receiving and positioning said workpieces in a position collinear with said cylinder bores.

9. The rotary machine according to claim 1 further comprising first biasing means biasing said plunger toward said first position.

10. The rotary machine according to claim 1 wherein said valve means comprises a plug attached to said valve stem disposed within said probe bore, said probe bore being stepped thereby forming an annular shoulder between bore sections, wherein in said first valve stem position said plug seals against said shoulder, and in said second depressed position said plug is forced from contact with said shoulder thereby permitting said material to flow within said probe bore.

11. The rotary machine according to claim 10 further comprising second biasing means urging said valve means in said first material shutoff position.

12. The rotary machine according to claim 1 wherein said stop means comprises a stop cylinder having an internal bore, an internally disposed stop plunger in said bore, and thread biasing means biasing said plunger within said bore.

13. A rotary machine for applying fluid material within fastener nut comprising:

a rotating turntable forming at least one peripheral notch therebetween for positioning said nut, at least one cylinder having a first and second opened end and an internal bore, said cylinder attached to said turntable, means for positioning the internal bore of said nut in registry with said cylinder internal bore, a first plunger disposed within said cylinder bore adjacent said first opened end, said first plunger further having a cam follower, an elongated probe connected to said first plunger and movable therewith having a bore therein and at least one radially opening material discharge port communicating with said bore, means for supplying said fluid material to said probe bore, a non-rotating cam surface communicating with said cam follower causing said first plunger to move between a first position to a second inserted position as said turntable is rotated, said probe extending from said cylinder second opened end when said first plunger is in said second position, valve means having a valve stem protruding from said probe, said valve stem movable between a first material shutoff position to a second depressed position at which said fluid material is permitted to flow from said probe discharge port, a second plunger disposed within said cylinder and positioned between said first plunger and said cylinder second opened end, said second plunger having an internal bore which closely receives said probe, stop means operatively associated with said turntable such that when said first plunger is in said first position, said nut is insertable within said notch and wherein as said plunger is moved to said second position, said probe is inserted within said nut internal cavity and said valve stem is depressed against said stop means thereby causing said fluid material to flow through said probe discharge port onto said internal cavity of said workpiece, and biasing means biasing said second plunger toward a first position wherein said second plunger is withdrawn into said cylinder bore adjacent said second opened end when said plunger is in its first position toward a second position extended from said cylinder second opened end when said first plunger is in its second position, said second plunger thereby clamping said nut when said material flows from said ports, and said second plunger thereby extending from said cylinder second opened end when said nut is not present thereby closing off said discharge port and preventing material flow when said nut is absent.

14. The rotary machine according to claim 13 wherein a plurality of said cylinders are provided and are attached to said turntable such that a plurality of said nuts are retained within said notches simultaneously.

15. The rotary machine according to claim 13 wherein said valve means comprises a plug attached to said valve stem disposed within said probe bore, said probe bore being stepped thereby forming an annular shoulder between bore sections, wherein in said first valve stem position said plug seals against said shoulder, and in said second depressed position said plug is forced from contact with said shoulder thereby permitting said material to flow within said probe bore.

16. The rotary machine according to claim 13 wherein said stop means comprises a second cylinder having an internal bore, an internally disposed plunger in said bore, and biasing means biasing said plunger within said bore.

* * * * *